US007650005B2

(12) United States Patent
Chalupper

(10) Patent No.: US 7,650,005 B2
(45) Date of Patent: Jan. 19, 2010

(54) AUTOMATIC GAIN ADJUSTMENT FOR A HEARING AID DEVICE

(75) Inventor: Josef Chalupper, Paunzhausen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 814 days.

(21) Appl. No.: 11/416,494

(22) Filed: May 2, 2006

(65) Prior Publication Data

US 2006/0245610 A1 Nov. 2, 2006

(30) Foreign Application Priority Data

May 2, 2005 (DE) ..... 10 2005 020 317

(51) Int. Cl.
*H04R 25/00* (2006.01)

(52) U.S. Cl. ..... 381/320; 381/312; 381/321

(58) Field of Classification Search ..... 381/312, 381/316–318, 321

See application file for complete search history.

(56) References Cited

U.S. PATENT DOCUMENTS 5,729,658 A 3/1998 Hou et al.
5,835,611 A 11/1998 Kaiser et al.
6,058,195 A * 5/2000 Klippel ..... 381/96
6,115,478 A * 9/2000 Schneider ..... 381/314
6,236,731 B1 * 5/2001 Brennan et al. ..... 381/316
2003/0002699 A1 1/2003 Schulz et al.

FOREIGN PATENT DOCUMENTS

DE 44 18 203 C2 12/1995
DE 101 31 964 A1 1/2003

OTHER PUBLICATIONS

U.Tietze, CH. Schenk, "Halbleiter-Schaltungstechnik", 1990, pp. 1018-1019, Springer-Verlag, Berlin, Heidelberg, NewYork, London, Paris, Tokyo, Barcelona.

A. Kučera, "The Compact Dictionary of Exact Science and Technology", English-German, 1989, vol. I, Oscar Brandstetter Verlag GmbH & Co. KG, Wiesbaden.

* cited by examiner

*Primary Examiner*—Suhan Ni

(57) ABSTRACT

The object of the claimed hearing aid device is to improve the speech intelligibility of a speech signal transmitted by the hearing aid device. To this end provision is made to define a maximum gain of the input signal and to determine a target gain at least at a first and second frequency of an input signal. A resulting gain is set in the hearing aid device, which does not exceed the maximum gain. A reduction of the resulting gain compared with the target gain at the first frequency is compensated for according to the invention by an automatic increase in the set resulting gain compared with the target gain at the second frequency, with compensation preferably being achieved by improving the speech intelligibility of a speech signal transmitted with the aid of the hearing aid device.

15 Claims, 4 Drawing Sheets

AUTOMATIC GAIN ADJUSTMENT FOR A HEARING AID DEVICE

CROSS REFERENCE TO RELATED APPLICATIONS

This application claims priority of German application No. 102005020317.5 filed May 2, 2005, which is incorporated by reference herein in its entirety.

FIELD OF THE INVENTION

The invention relates to a method for adjusting or operating a hearing aid device and a hearing aid device with at least one input converter for receiving an input signal and converting it to an audio signal, a signal processing unit for processing and amplifying the audio signal and an output converter.

BACKGROUND OF THE INVENTION

With modem hearing aid devices there are a large number of possible options for adjusting the transmission function, in other words the gain of an input signal over frequency. In particular the transmission function of a modem hearing aid device can be adjusted by tailoring the hearing aid device to the individual hearing loss of a user.

A method for tailoring the transmission characteristics of a hearing aid device defined by parameters specific to the hearing aid device using a personal computer is known from DE 44 18 203 C2, a memory for base values of a hearing aid device setting in conjunction with an algorithm and a data memory supplying a transmission characteristic of the hearing aid device and displaying it on the screen of the personal computer as a graphic curve.

It is also known that the transmission response of a hearing aid device can also change during normal operation of the hearing aid device. On the one hand the user can change the transmission characteristics of the hearing aid device by manual activation of operating elements on the hearing aid or a remote control unit. It is thus possible for example to switch between different hearing programs or to vary the volume setting. Modem hearing aid devices are also frequently equipped with different automatic systems, which automatically influence the transmission function as a function of the current ambient situation or specific system states.

A method for operating a hearing aid device is known from DE 101 31 964 A1, in which a transmission characteristic of maximum gain over frequency is determined. If, due to an automatic or manual change of parameters relating to signal processing in the hearing aid device, the gain is now increased beyond the characteristic of maximum gain in one specific frequency range at least, the resulting gain in this frequency range is limited automatically to the preset maximum gain for the frequency range in question.

Hearing aid device wearers frequently encounter the problem that the speech intelligibility they experience does not correspond to the speech intelligibility of a person with normal hearing, despite the use of a hearing aid device. Different speech intelligibility models are known from the prior art, which show the frequency ranges that are particularly important for speech intelligibility. This knowledge can advantageously also be used to adjust devices that reproduce or transmit speech, such as hearing aid devices.

A method is known from U.S. Pat. No. 5,729,658, with which speech intelligibility can be quantified for a device that transmits, amplifies or reproduces acoustic speech signals.

This makes it possible to compare different devices or different settings of a device in respect of their speech reproduction.

SUMMARY OF THE INVENTION

In the case of hearing aid devices the problem of acoustic feedback continually arises. This occurs particularly frequently in the case of hearing aid devices with a high level of gain. The feedback manifests itself in significant oscillations of a specific frequency caused by the feedback. Such "whistling" is generally highly unpleasant both for the hearing aid device wearer and for people in their direct proximity. The whistling typical of feedback is generally relatively high frequency. Feedback can occur when sound received via the microphone of the hearing aid device, amplified by a signal amplifier and output via the earpiece, gets back to the microphone and is amplified again. For the typical whistling, generally at a dominant frequency, to occur, two further conditions have to be satisfied. The so-called loop gain of the system, i.e. the product of the hearing aid device gain and the attenuation of the feedback path, must be greater than 1. The phase displacement of this loop gain must also correspond to any whole multiple of 360°.

The simplest approach to reducing oscillations caused by feedback is the permanent reduction of hearing aid device gain, such that loop gain remains below the critical limit value even in unfavorable situations. The major disadvantage of this is however that such limiting means that the hearing aid device gain required with more serious hearing problems can no longer be achieved.

A so-called open loop gain measurement allows the pattern of critical gain to be determined. Critical gain here is the gain which cannot be exceeded, if feedback is not to occur in a hearing aid device worn by an individual person. However this means that the adjustable gain can no longer compensate fully for the hearing loss of the hearing aid device wearer, particularly at the higher frequencies transmitted by the hearing aid device. This means that instead of the target gain required to compensate for the hearing loss, a lower resulting gain is set, which is limited to the critical gain. The resulting gain is generally even set a certain amount lower than the critical gain, to ensure a "safe gap" from the critical gain. The problem then occurs that the gain reduction generally has a detrimental effect on speech intelligibility in the case of a speech signal transmitted by the hearing aid device.

One object of the invention is to tailor parameter settings of a hearing aid device automatically such that improved speech intelligibility results in the case of a speech signal transmitted by the hearing aid device.

This object is achieved by a method with the method steps according to the claims.

In the case of a hearing aid device an input signal is generally received by means of an input converter and converted to an electrical input signal. At least one microphone generally serves as the input converter, receiving an acoustic input signal. Modem hearing aid devices frequently comprise a microphone system with a number of microphones, in order to achieve reception as a function of the incident direction of acoustic signals, in other words a directional characteristic. An input converter can however also be configured as a telephone coil or an antenna for receiving electromagnetic input signals. The input signals converted by the input converter to electrical input signals are fed to a signal processing unit for further processing and amplification. The further processing and amplification serve to compensate for the individual hearing loss of a hearing aid device wearer, generally as a function of the signal frequency. The signal processing unit emits an electrical output signal, which is fed via an output converter to the ear of the hearing aid device wearer, such that said hearing aid device wearer perceives the output signal as an acoustic output signal. The output converters are generally earpieces, which generate an acoustic output signal. However output converters for generating mechanical vibration are also known, which cause specific parts of the ear, for example the ossicles of the ear, directly to vibrate. Output converters are also known, which stimulate nerve cells of the ear directly.

The claimed method can be executed when tailoring a hearing aid device to the individual hearing loss of a hearing aid device wearer, with the adjustments being executed at a programming device, but it can also be used during ongoing operation of the hearing aid device.

In the case of a hearing aid device, it is frequently not possible to adjust the gain for the entire frequency spectrum that can be transmitted by the hearing aid device, as required to compensate for the individual hearing loss of a hearing aid device wearer. This is particularly so to prevent feedback. Hearing aid device gain is therefore limited to a maximum gain individually for the respective hearing aid device wearer. The exact pattern of the respective maximum gain can for example be determined by means of an open loop gain measurement. Such a measurement provides a defined transmission characteristic of a maximum gain of an input signal over frequency for the hearing aid device and the individual user.

A target gain is also defined, as required to compensate for the individual hearing loss of the hearing aid wearer. For the frequency ranges, in which the target gain is above the critical gain, the resulting gain, i.e. the gain actually set in the hearing aid device, cannot exceed the critical gain. The gain actually set is therefore limited to the critical gain in the frequency ranges, in which the target gain is above the critical gain. In general a "safety gap" is provided between the resulting gain and the critical gain, in order to be able to exclude feedback to a large extent even during everyday operation of the hearing aid device.

Reducing the resulting gain compared with the target gain generally has a detrimental effect on speech intelligibility for a hearing aid wearer supplied with the hearing aid device in question. The core of the invention is now to compensate automatically in respect of speech intelligibility, when a resulting gain has to be set in a specific frequency range, which is below the target gain that is actually desirable.

The invention can be applied to all known hearing aid device types, for example behind-the-ear hearing aid devices, in-the-ear hearing aid devices, implantable hearing aid devices and pocket hearing aid devices. The claimed hearing aid device can also be part of a hearing device system comprising a number of devices for assisting a person with hearing problems, e.g. part of a hearing device system with two hearing aid devices worn at the head for binaural coverage or part of a hearing device system comprising a device that can be worn at the head and a processor unit that can be carried on the person.

BRIEF DESCRIPTION OF THE DRAWINGS

The invention is described below with reference to exemplary embodiments, in which.

DETAILED DESCRIPTION OF THE INVENTION

Figure 1:
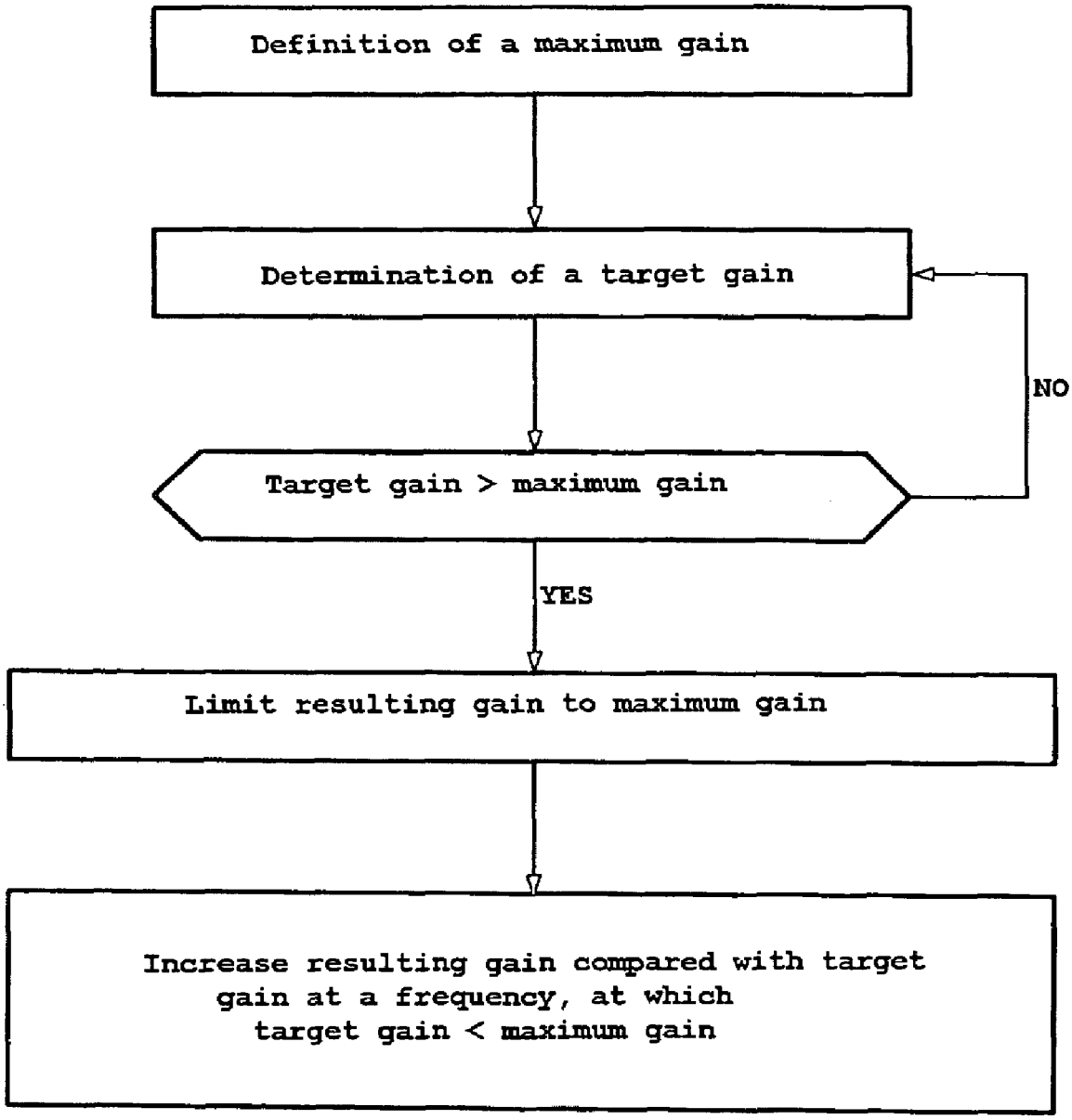
FIG. 1 shows a flow diagram of a claimed method.

FIG. 1 shows the essential method steps when implementing a claimed method. First a target gain and maximum gain over frequency are defined for an individual hearing aid device wearer to be supplied with a specific hearing aid device. The target gain is thereby the gain which actually should be achieved with the hearing aid device, for example to compensate for the hearing loss of the hearing aid device wearer. The maximum gain is the gain, which can be achieved as a maximum with the hearing aid device in question, taking into account technical and anatomical conditions as a function of the frequency of an input signal. The sequence of the above two method steps is thereby inconsequential.

In a next method step it is verified whether the target gain at a specific frequency or for a specific frequency range exceeds the maximum gain. If so, the resulting gain, i.e. the gain to be set in the hearing aid device, is limited to the maximum gain for these frequencies. A "safety gap" can thereby optionally be taken into account between the resulting gain and the maximum gain, by which the resulting gain actually set in the hearing aid device remains below the maximum gain.

To compensate for such gain limiting, according to the invention the gain set in the hearing aid device at another frequency or in another frequency range, for which the target gain is below the maximum gain, is then automatically increased compared with the target gain.

Figure 2:
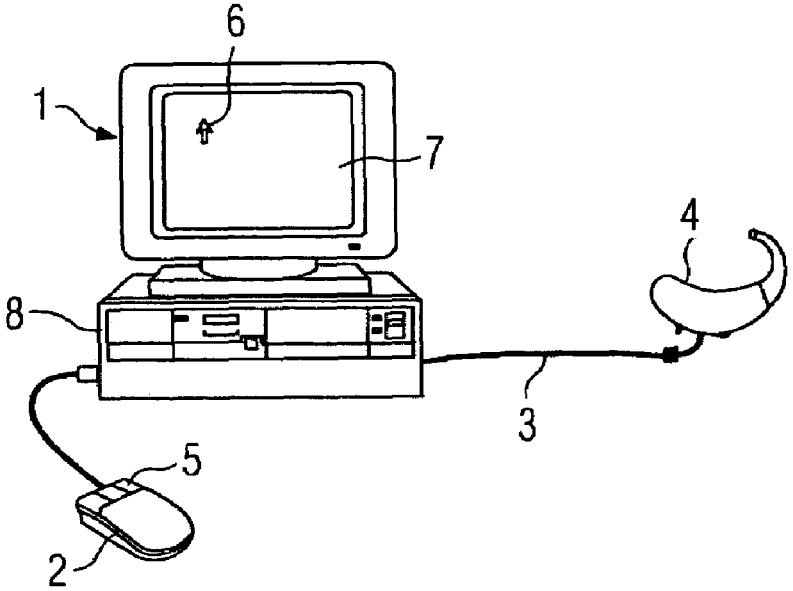
FIG. 2 shows a hearing aid device connected to an adjustment device.

FIG. 2 shows a schematic illustration with differing scales of an adjustment device configured as a personal computer (PC) 1 with a computer mouse 2 and a programmable hearing aid device 4 that can be connected via an interface (not shown) using a cable 3. A pointer 6 that can be operated via a mouse button 5 is shown on the screen 7 of the PC. A data memory and computing devices known per se and also not shown in the figure are provided in the data processing unit 8.

The described method can operate on the adjustment device 1 to tailor the hearing aid device 4 to an individual hearing loss. To this end the target gain, the maximum gain and the resulting gain can be displayed on the graphic operator interface as transmission characteristics. The resulting gain can be limited to the maximum gain manually, for example by using the mouse 2 to click and drag the characteristic of the resulting gain. The resulting gain can however also be limited to the maximum gain automatically. It is essential in the context of the invention that whenever a resulting gain has to be set below the target gain at a specific frequency or in a specific frequency range, compensation is automatically achieved, in that the resulting gain is automatically increased compared with the target gain at at least one other frequency or in at least one other frequency range, the increase of course only being possible to the extent that the maximum gain at this other frequency or in this other frequency range is not exceeded.

It should be noted that the described method can in fact be implemented, even if the target gain and the resulting gain are not displayed simultaneously as two different transmission characteristics at the operator interface. For example just one hearing aid device transmission characteristic could constantly be displayed, which is then adjusted when programming the hearing aid device. This transmission characteristic is predefined once, for example using a "first fit algorithm"

and then modified in the course of the adjustment. The transmission characteristic defined at the start of the adjustment would then correspond to the target gain and the transmission characteristic obtained at the end of the adjustment would correspond to the resulting gain, which is ultimately set at the hearing aid device. A target gain and a resulting gain would then be shown at the operator interface, not simultaneously but one after the other. However the distinction between target gain, maximum gain and resulting gain is more suitable for illustrating the invention.

Just as when adjusting a hearing aid device, the claimed method can also be implemented during ongoing operation of a hearing aid device. Modem hearing aid devices offer a number of options for modifying the transmission characteristic of the hearing aid device during operation. In the simplest instance such a hearing aid device for example comprises a volume controller, with which the volume and therefore the gain can be increased or reduced manually. A number of different methods are also known for hearing aids, which modify the transmission function of the hearing aid device automatically. Such methods for example include methods for automatically tailoring signal processing in a hearing aid device to different ambient situations. This can also mean that it is desirable during operation to set a target gain, which exceeds the maximum gain set for the individual hearing aid device wearer and the hearing aid device in question at at least one frequency. To prevent feedback however only a resulting gain is thereby set, which is at most equal to the maximum gain but does not exceed it. This can also mean that there is some deterioration in speech intelligibility when a user is supplied with the hearing aid device in question, due to the difference between the resulting gain and the target gain that is actually desirable. Here too the invention makes provision to compensate for the deterioration in speech intelligibility resulting from the difference between the target gain and the resulting gain. This is achieved with the claimed hearing aid device in that to compensate for the gain in another frequency range, in which the maximum gain is above the target gain, a resulting gain is automatically set between the target gain and the maximum gain. In other words, the gain reduction required for technical reasons, in particular to prevent feedback, in a first frequency range is again at least partially compensated for by an automatic gain increase in a second frequency range.

According to the invention the resulting gain is preferably increased beyond the target gain using a speech intelligibility model. It has proven specifically that certain frequency ranges have a significantly greater influence on speech intelligibility than other frequency ranges. The frequency range in the region of one kHz in particular is particularly important for speech comprehension. In contrast feedback generally occurs at higher frequencies. The setting of the gain below the target gain that is actually desirable can thus be extenuated in relation to speech intelligibility by increasing frequencies in the region of one kHz. A speech intelligibility model can thereby even be used for optimization in respect of speech intelligibility, in that an optimum is determined in respect of frequency range and the exact value of the increase using the speech intelligibility model. The increase can of course thereby be effected only within a specific framework, defined for example by the maximum gain, the individual discomfort threshold of the hearing aid device wearer or the perceived loudness of a signal transmitted with the hearing aid device. In particular the gain is advantageously adjusted not only on the basis of a speech intelligibility model but also optionally on the basis of a loudness model. It is thus possible to define a further basic condition for automatic gain adjustment to the effect that the overall impression of loudness should not change or should change only slightly.

Figure 3:
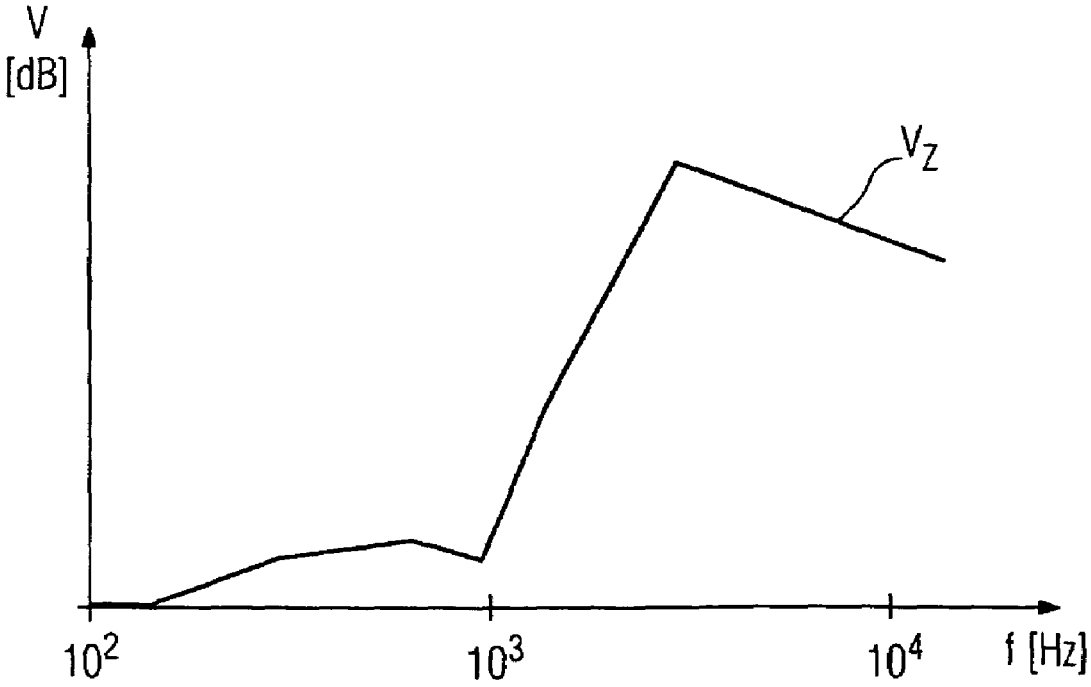
FIG. 3 shows a characteristic of a target gain over frequency.
Figure 4:
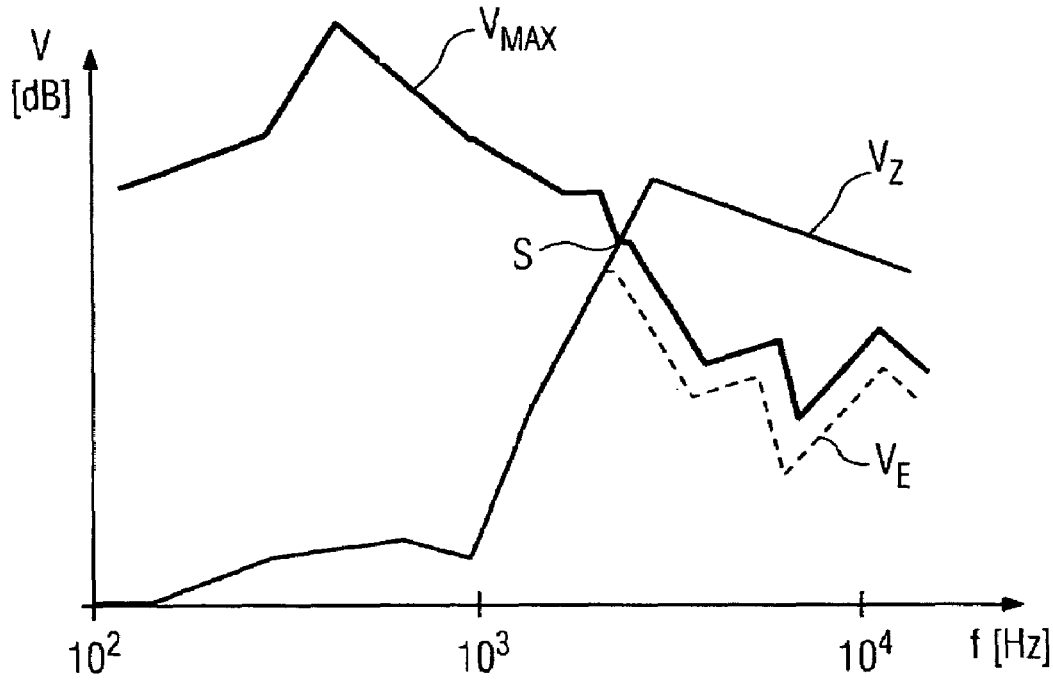
FIG. 4 shows the characteristic of target gain and a characteristic of maximum gain over frequency.
Figure 5:
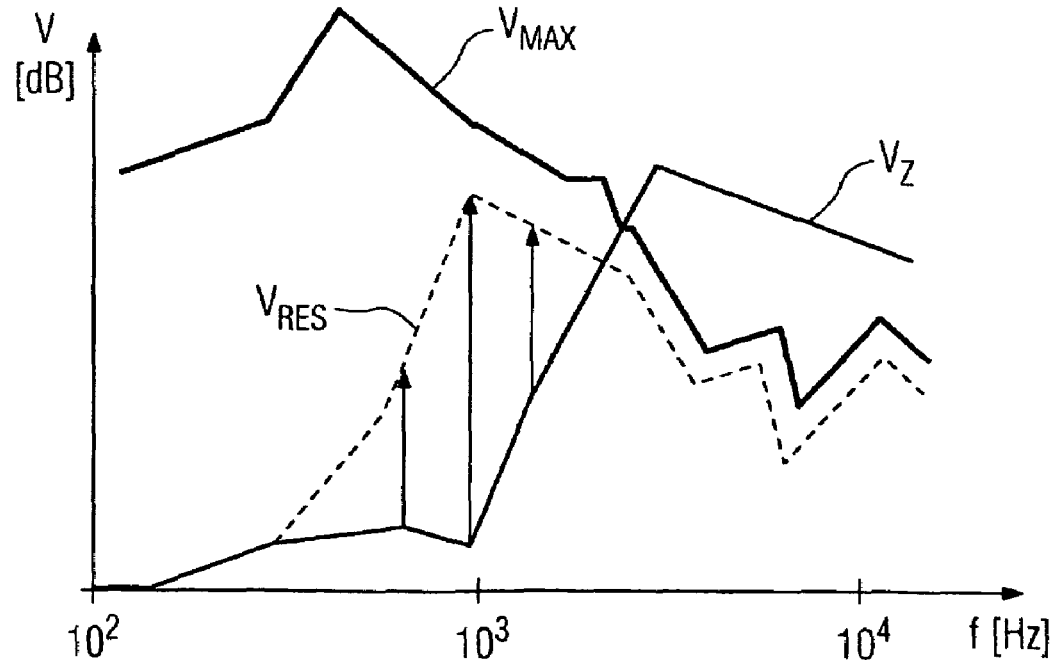
FIG. 5 shows a resulting gain adjusted according to the invention.

FIGS. 3 to 5 show a graphic illustration of the claimed procedure based on transmission characteristics. FIG. 3 shows the characteristic of a target gain $V_Z$ over frequency for an individual person. This target gain results for example from an audiogram of the hearing aid device wearer. In addition to the audiogram however a number of further parameters can also be included in the definition of target gain, e.g. individual user inputs in a programming device during adjustment of the hearing aid device in question. Target gain can also change during ongoing operation of the hearing aid device, whether due to manual adjustments by the user (e.g. manual changes to the volume setting) or automatically, e.g. by means of algorithms operating in the hearing aid device, for example for situation recognition, automatic gain control (AGC), feedback suppression, etc.

The characteristic $V_Z$ in the exemplary embodiment shows the target gain of an input signal by the hearing aid device required in the current conditions to compensate for the individual hearing loss. However due to technical and anatomical conditions it is frequently not possible actually to set this target gain at the hearing aid device in question. In the exemplary embodiment only the maximum gain $V_{MAX}$ shown additionally in FIG. 4 compared with FIG. 3 can be set for the hearing aid device to be adjusted and the user in question. The characteristic $V_{MAX}$ can for example result from an open loop gain measurement and can take into account the feedback gradient of the hearing aid device for the individual user. As shown in FIG. 4, the characteristic $V_Z$ exceeds the characteristic $V_{MAX}$ to the right of the common intersection point S. This means that to prevent feedback in this frequency range, the target gain $V_Z$ cannot be adjusted for the hearing aid device in question. Before the invention a gain characteristic $V_E$ was therefore adjusted, which to the left of the intersection point S essentially corresponds to the target gain $V_Z$ and to the right of the intersection point S runs below the maximum gain $V_{MAX}$ with a specific safety gap. The difference between $V_E$ and $V_Z$ generally results in a deterioration in speech intelligibility for a hearing aid device wearer supplied with the hearing aid device in question.

FIG. 5 shows the claimed automatic increase in the resulting gain $V_{RES}$ compared with the target gain $V_Z$. The increase is highlighted graphically in particular by the marked arrows. It shows that the frequency range above and below one kHz in particular is increased compared with the originally intended target gain. The increase is thereby effected preferably on the basis of a speech intelligibility model, by means of which a value is generated for the gain in speech intelligibility for different frequencies and different values of the respective increase, such that an optimum can be achieved for speech intelligibility using known optimization methods. The gain increase is also effected taking into account a loudness model, which provides a measure of the impression of the loudness of a signal amplified according to the characteristics shown. The characteristic $V_E$ according to FIG. 4, which has been adjusted in relation to the target characteristic $V_Z$ thereby also generates a reduction in volume, which can be at least partially compensated for again by the increase in gain at lower frequencies effected in the manner shown in FIG. 5. Speech intelligibility is advantageously optimized taking into account loudness, such that an improvement in speech intelligibility is achieved without significantly increasing the loudness experienced by the user.

When implementing the claimed method during operation of the hearing aid device in question the gain is both increased and reduced automatically, to obtain the resulting gain $V_{RES}$ from the target gain $V_Z$. Corresponding algorithms for adjusting gain are implemented to this end in the hearing aid device.

Also when implementing the claimed method in an adjustment device it is possible, after defining the maximum gain $V_{MAX}$ and after determining the target gain $V_Z$, for a resulting gain $V_{RES}$ to be generated automatically for the overall frequency range that can be transmitted with the hearing aid device. It is also possible for the operator of the adjustment device to make manual adjustments to the transmission characteristics, by for example clicking and dragging a curve with a pointer device, with a change in the transmission characteristic $V_{RES}$ taking place automatically elsewhere according to the invention when such a gain reduction is implemented at a frequency or in a frequency range, so that little deterioration in speech intelligibility results at the most due to the gain reduction.

Figure 6:
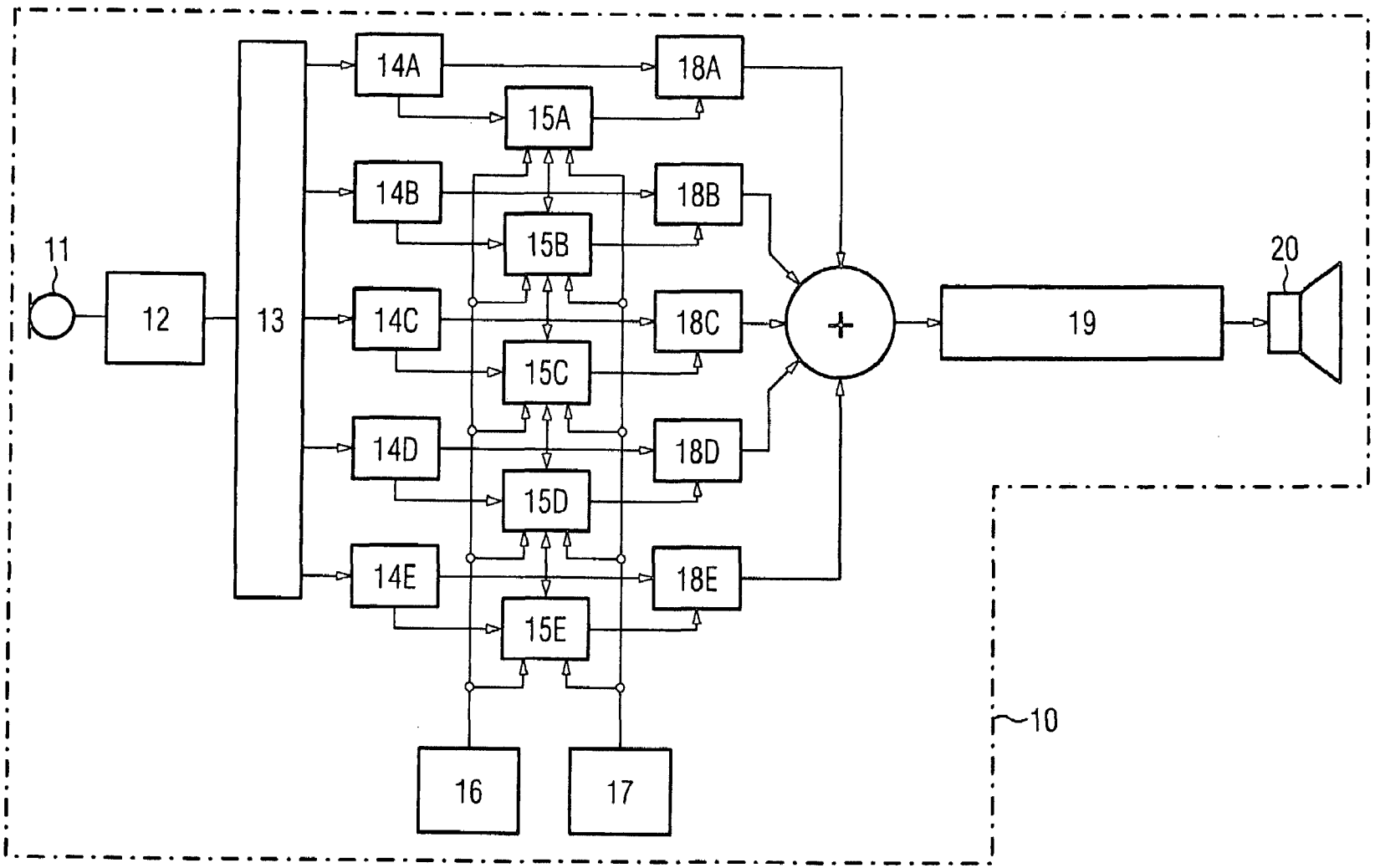
FIG. 6 shows a block circuit diagram of a claimed hearing aid device.

FIG. 6 shows an example of a block circuit diagram of a hearing aid device with a gain controller according to the invention. The input converter used in the hearing aid device 10 according to FIG. 4 is a microphone 11, which receives an acoustic signal and converts it to an audio signal, i.e. an electrical sound signal. The resulting audio signal is fed first to a pre-amplifier and A/D converter unit 12, in which the initially analog audio signal is converted to a digital audio signal. For further processing in a number of parallel channels of the hearing aid device, the digital audio signal is split by means of the filter bank 13 into a number of frequency bands (channels). The audio signals of the individual channels are first fed to signal processing units 14A-14E, in which the audio signals are filtered in a different manner, e.g. for tailoring to the individual hearing problem of a hearing aid device wearer. Signal analysis also takes place in the signal processing units 14A-14E, for example to determine the signal level, to detect the current hearing situation or to identify the existing of interfering noise. Parameters are derived from this signal analysis and then fed to automatic gain control units 15A-15E. Parameters stored in a memory 16 and characterizing standard gain and maximum gain of the audio signal over frequency for the respective channel are also fed to the latter. Standard gain defines an initial gain value for every frequency of the transmittable frequency range during the gain calculation and can be defined both from a standard gain setting by the hearing aid device manufacturer and by a setting set by the acoustician when adjusting the hearing aid device. Maximum gain can also be preset by the hearing aid device manufacturer and adjusted individually by the acoustician. Almost any forms of pattern of gain over frequency can be set in the audible frequency range for both gains. As shown in the exemplary embodiment, the current setting of a volume controller 17 can also be fed to the automatic gain control units 15A-15E. The automatic gain control units 15A-15E use the parameters fed to them to determine a specific target gain for every frequency. Thus for example the standard gain can be 50 dB for one channel (initial gain value), compression to the factor 0.8 can take place due to a very high signal input level ($1^{st}$ gain modification value), the signal can be increased by 10 dB based on the volume controller 17 ($2^{nd}$ gain modification value) and finally it can be reduced by 20 dB due to a detected interference signal ($3^{rd}$ gain modification value), such that an overall gain modification value of −20 dB and therefore a target gain of 30 dB ultimately result taking into account all gain modification values. If this target gain at the respective frequency is less than or equal to the maximum gain, this gain is also the effective resulting gain. Otherwise the target gain is limited to the maximum gain, such that the latter is the effective resulting gain. In the latter instance the invention intervenes such that the undesirable but necessary gain reduction is at least partially compensated for by a gain increase in another frequency range. Provision is made for this purpose for a data exchange between the individual automatic gain control units 15A to 15E, which effect the gain increase according to the invention in at least one frequency band. The increase is thereby advantageously effected on the basis of a speech intelligibility model and a loudness model. In the exemplary embodiment amplifiers 18A to 18E are correspondingly controlled for this purpose in the channels of the hearing aid device 10 by the automatic gain control units 15A to 15E. After amplification the audio signals of the individual channels are recombined and fed, optionally after signal post-processing in the signal post-processing unit 19, in which filtering, final amplification and D/A conversion for example take place, to an earpiece 20. This converts the processed electrical audio signal back to an acoustic signal, which is emitted into the auditory canal of the hearing aid device wearer.

The invention offers the advantage that with the hearing aid device 10 in question the gain is controlled taking into account anatomical and technical conditions such that optimum speech intelligibility and an optimum impression of loudness are achieved.

The invention claimed is:

1. A method for adjusting a hearing aid device, comprising:

receiving an input signal with an input converter;

converting the input signal to an audio signal with the input converter;

processing and amplifying the audio signal as a function of frequency with a signal processing unit;

generating an output signal that is perceived by a hearing aid device wearer as an acoustic signal with an output converter;

defining a maximum gain of the audio signal at a first and second frequency of the audio signal;

determining a target gain of the audio signal at the first and second frequency of the audio signal;

setting a resulting gain at the first frequency of the audio signal, wherein the resulting gain is set to the target gain if the target gain does not exceed the maximum gain at the first frequency, wherein the resulting gain is limited to the maximum gain if the target gain exceeds the maximum gain at the first frequency; and automatically increasing the resulting gain compared with the target gain at the second frequency if the resulting gain at the first frequency is limited to the maximum gain, wherein the resulting gain at the second frequency is increased above the target gain at the second frequency and is limited to the maximum gain at the second frequency.

2. The method as claimed in claim 1, wherein the maximum gain and the target gain at the first and second frequency of the audio signal are determined in a plurality of frequency bands.

3. The method as claimed in claim 1, wherein the maximum gain is defined and the target gain is determined and the resulting gain is set during an adjustment of the hearing aid device using an adjustment device.

4. The method as claimed in claim 1, wherein the maximum gain is defined and the target gain is determined and the resulting gain is adjusted during an operation of the hearing aid device.

5. The method as claimed in claim 1, wherein an open loop gain measurement is carried out to determine the maximum gain.

6. The method as claimed in claim 1, wherein a speech intelligibility of the output signal is increased by increasing the resulting gain compared with the target gain at the second frequency.

7. The method as claimed in claim 6, wherein the speech intelligibility of the output signal is increased based on a speech intelligibility model.

8. The method as claimed in claim 7, wherein the speech intelligibility model indicates that a frequency range has a greater influence on speech intelligibility of the output signal than other frequency ranges.

9. The method as claimed in claim 8, wherein the speech intelligibility model indicates that the frequency range of one kHz has a greater influence on the speech intelligibility of the output signal than other frequency ranges.

10. The method as claimed in claim 1, wherein a loudness of the output signal is increased by limiting the resulting gain at the first frequency and increasing the resulting gain at the second frequency.

11. The method as claimed in claim 10, wherein the loudness of the output signal is determined by a loudness model.

12. The method as claimed in claim 11, wherein the loudness model provides a measure of a loudness of a signal amplified.

13. The method as claimed in claim 1, wherein the method is for operating the hearing aid device.

14. A computer adjustment device for tailoring a hearing aid device to an individual hearing loss of a hearing aid device wearer, comprising:

a personal computer connectable to the hearing aid device;

a data memory within the personal computer;

a computing device within the personal computer; and a graphic interface which displays transmission characteristics, wherein the hearing aid device comprises:

an input converter for receiving an input signal and converting the input signal to an audio signal, a signal processing unit for processing and amplifying the audio signal, an output converter for generating an output signal that is perceived by the hearing aid device wearer as an acoustic signal, a storage unit for storing a maximum gain of the audio signal at a first and second frequency, and a gain control unit for automatically determining a target gain and setting a resulting gain at the first and second frequency, wherein the resulting gain at the first frequency is limited to the maximum gain if the target gain exceeds the maximum gain at the first frequency, wherein the resulting gain compared with the target gain at the second frequency is increased to not exceed the maximum gain at the second frequency if the resulting gain at the first frequency is limited.

15. A hearing aid device, comprising:

an input converter for receiving an input signal and converting the input signal to an audio signal;

a signal processing unit for processing and amplifying the audio signal;

an output converter for generating an output signal that is perceived by a hearing aid device wearer as an acoustic signal;

a storage unit for storing a maximum gain of the audio signal at a first and second frequency; and a gain control unit for automatically determining a target gain and setting a resulting gain at the first and second frequency, wherein the resulting gain at the first frequency is limited to the maximum gain if the target gain exceeds the maximum gain at the first frequency, wherein the resulting gain compared with the target gain at the second frequency is increased to not exceed the maximum gain at the second frequency if the resulting gain at the first frequency is limited.

* * * * *

UNITED STATES PATENT AND TRADEMARK OFFICE

CERTIFICATE OF CORRECTION

PATENT NO. : 7,650,005 B2
APPLICATION NO. : 11/416494
DATED : January 19, 2010
INVENTOR(S) : Josef Chalupper It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 932 days.

Signed and Sealed this

Twenty-third Day of November, 2010

David J. Kappos

David J. Kappos
*Director of the United States Patent and Trademark Office*